United States Patent [19]

Maynard, Jr.

[11] 4,150,768

[45] Apr. 24, 1979

[54] CONTAINER OPENING AND POURING ATTACHMENT

[76] Inventor: Walter P. Maynard, Jr., 3070 Presidential Dr., Suite 234, Atlanta, Ga. 30340

[21] Appl. No.: 890,060

[22] Filed: Mar. 27, 1978

[51] Int. Cl.[2] ..... B67B 7/26

[52] U.S. Cl. ..... 222/89; 222/570; 220/306

[58] Field of Search ..... 222/80, 81, 87–89, 222/546, 563, 566, 570, 185 SP; 220/306; 215/317, 321

[56] References Cited

U.S. PATENT DOCUMENTS

| | | | |
|---|---|---|---|
| 1,088,332 | 2/1914 | Disher | 222/81 |
| 2,004,018 | 6/1935 | Strauss | 222/89 |
| 2,118,366 | 5/1938 | Spielvogel | 222/81 |
| 2,535,783 | 12/1950 | Churchill et al | 222/89 |
| 2,719,652 | 10/1955 | Williams | 222/81 |
| 3,972,453 | 8/1976 | Kapples | 222/570 |

*Primary Examiner*—Robert J. Spar
*Assistant Examiner*—H. Grant Skaggs
*Attorney, Agent, or Firm*—Newton, Hopkins & Ormsby

[57] ABSTRACT

A unitary piercing and pouring device for metal or paper containers of motor oil and like liquids embodies a skirted cover of somewhat resilient plastics material. The skirt portion of the cover has indentations carrying lugs on their interior sides for snapping engagement over the top bead of a container so that such bead is locked between the lugs and cover top wall. A piercing blade has teeth embedded into the pouring nozzle or spout and the blade includes elements which secure a sealing gasket against the cover top wall.

11 Claims, 9 Drawing Figures

CONTAINER OPENING AND POURING ATTACHMENT

BACKGROUND OF THE INVENTION

Container piercing and content pouring devices are well known in the prior art.

The principal objective of the present invention is to improve on the known prior art by providing a simpler, more economical and more convenient container piercing and pouring attachment which finds particular utility in connection with metal or paper cans for motor oil or like liquids. More particularly, the device of the invention is constructed so that it may be coupled conveniently and securely to a can of motor oil simultaneously with the piercing of such can, whereby the contents of the can may then be poured into the crankcase of an engine without spilling oil on the engine or on the hands of the user.

A particular feature of the invention takes advantage of the inherent resiliency of certain plastics materials to enable the body portion of the device to be readily applied securely to either metallic or paper cans which are known to differ slightly in diameter. To compensate for this difference, the invention utilizes gripping ribs which are mounted on deformable indentations in a side wall or skirt portion of the device, whereby ribs of slightly different radial depths may efficiently grip either the cylindrical metal or paper cans, both of which are widely used in the marketing of quarts of oil to the retail consumer.

Other improvement features of the invention over the prior art will become apparent during the course of the following detailed description.

BRIEF DESCRIPTION OF THE DRAWINGS

FIGS. 5 through 9 are partly schematic side elevations illustrating the operation of the invention in relation to a can of oil or the like.

DETAILED DESCRIPTION

Figure 1:
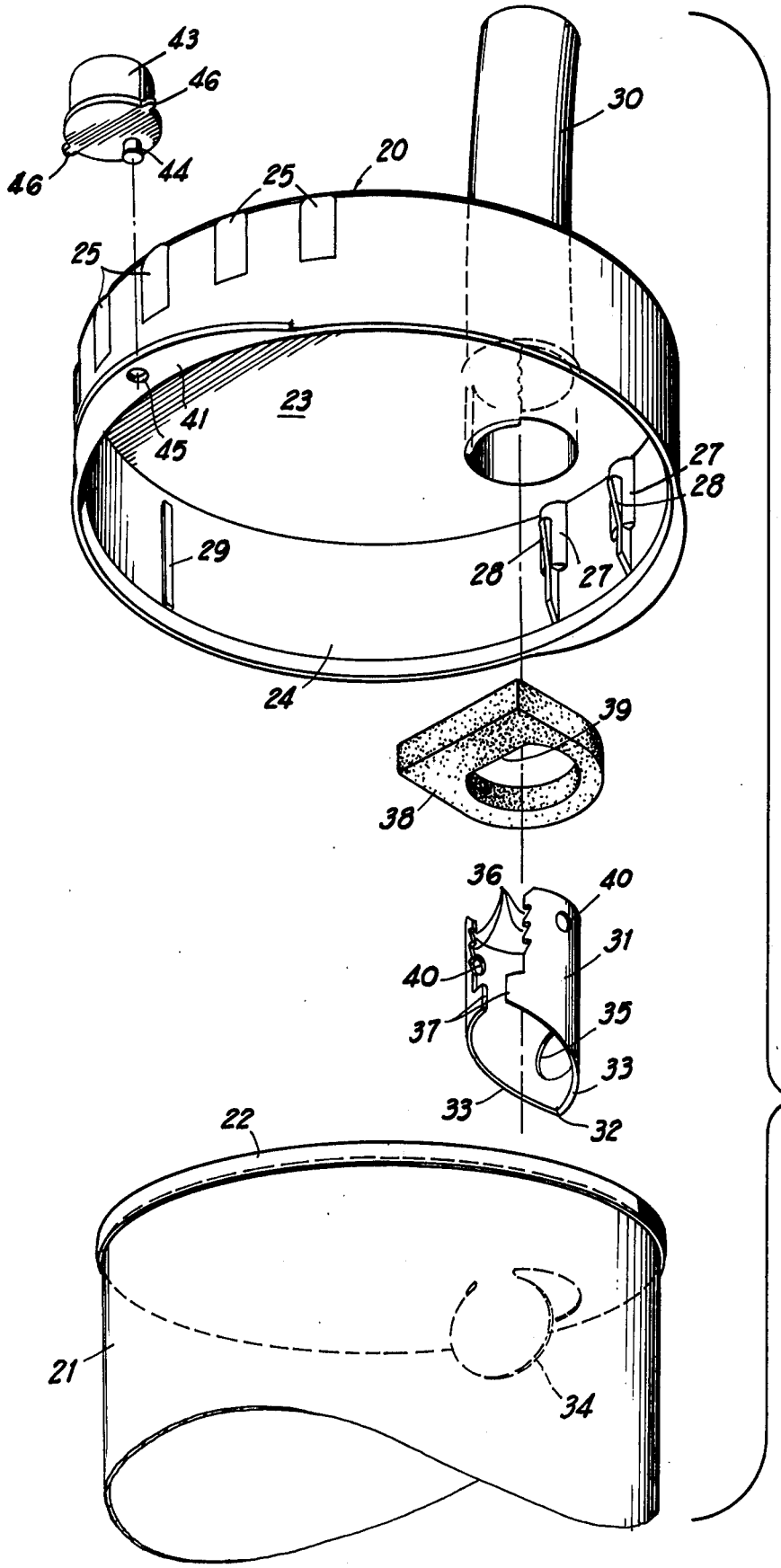
FIG. 1 is an exploded perspective view of the invention in relation to a container of the type on which the invention is used.

Referring to the drawings in detail, wherein like numerals designate like parts, the numeral 20 designates a container opening and content pouring attachment in its entirety forming the subject matter of the invention. The invention is utilized with a cylindrical can 21 for motor oil or the like which can may be formed of metal or paper, in each case including a top bead 22. It may be noted here that the two types of cans consistently vary slightly in their outside diameters, the paper cans being 0.070 inches greater in diameter than the metal cans. A feature of the invention, to be fully described, is its adaptability to either type of can customarily used to market quarts of motor oil to the motoring public.

With continued reference to the drawings, the device 20 comprises a can cover or body portion having a top wall 23 and a depending annular skirt 24 formed integral therewith. This cover or body portion is preferably formed of medium or high density polyethylene or polypropylene plastics, in the density range of 0.945 to 0.952. Such plastics are tough and durable and possess a fair degree of resiliency which is required for the purposes of the invention.

The cover skirt 24 is provided with preferably five circumferentially equidistantly spaced indentations 25 which extend from points near the axial center of the skirt 24 through the top of the cover as defined by the top wall 23. On their interiors, the indentations 25 carry vertically elongated ribs 26 which are inclined upwardly away from the skirt 24, the tops of the ribs terminating a uniform distance below the top wall 23. An important feature of the invention is that the indentations 25 possess an ability to flex or yield in response to pressure on the ribs 26 so that the can bead 22 can pass upwardly over the ribs and expand them radially with the ribs snapping under the bead and holding it captive between the tops of the ribs 26 and the top wall 23.

Figure 3:
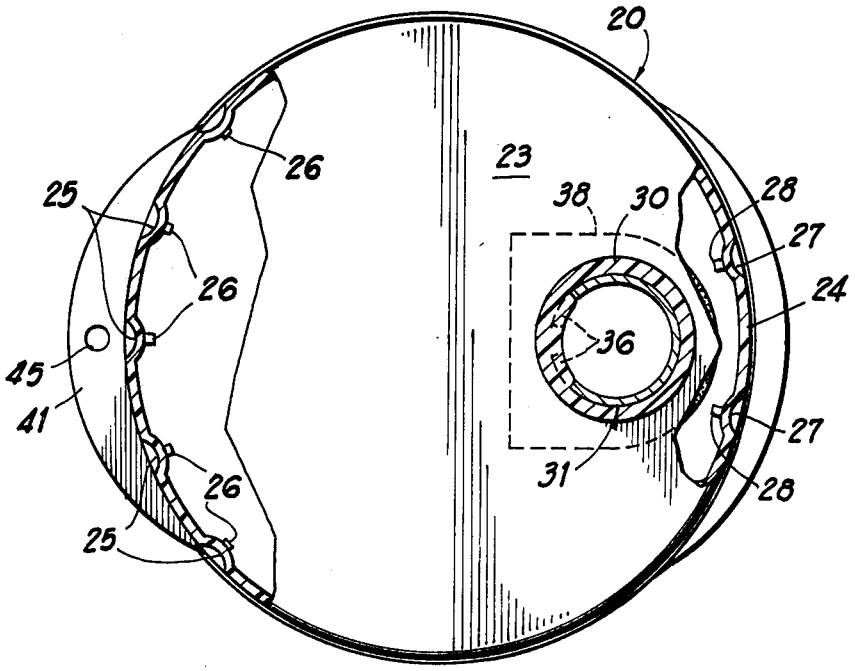
FIG. 3 is a horizontal section, partly in elevation, showing yielding indentations and ribs forming an important aspect of the invention.
Figure 4:
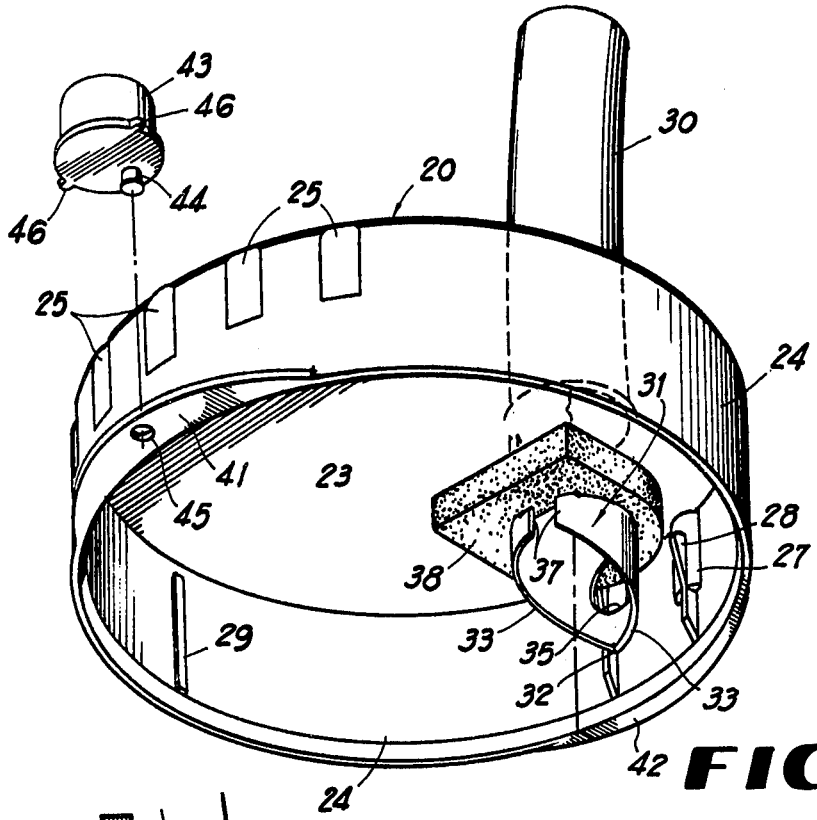
FIG. 4 is an assembled perspective view of the invention showing a nozzle closure plug separated from the body of the invention.
Figure 5:
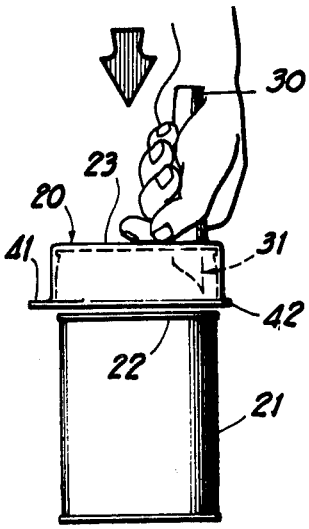

The middle rib 26, FIG. 3, projects approximately 0.005 inches radially inwardly of the indentation 25. The two ribs immediately on opposite sides of the middle rib project approximately 0.040 inches radially inwardly and the remaining two outermost ribs 26 project approximately 0.030 inches radially, these dimensions being shown on an exaggerated scale in FIG. 3 and elsewhere in the drawings. These differences in the radial dimensions of the can gripping ribs 26 allow the invention to efficiently engage containers of either the metal or paper types. As previously noted, the paper cans are about 0.070 inches larger in diameter than the metal ones. The described rib formation, together with the resiliency of the plastics material from which the invention is made, enable it to adapt efficiently to both types of cans.

At a region of the skirt 24 diametrically opposite the several indentations 25, the skirt 24 has an additional pair of indentations 27 carrying internal ribs 28 of uniform radial depth and being profiled longitudinally in the same manner as the ribs 26. As will be further discussed in FIGS. 5 to 9, when the device 20 is forced onto the top of a can 21, the can bead passes upwardly over the several ribs 26 and 28 causing them to expand outwardly and then snap inwardly beneath the bead 22 due to the resiliency of the plastics material, to lock the bead 22 between the tops of the ribs and the top wall 23 of the device. Additional stiffening ribs 29 are preferably formed on the interior of the skirt 24 to increase its rigidity and strength.

The device 20 has a pouring nozzle or spout 30 formed integral therewith near and inwardly of the ribs 28 and indentations 27. This spout rises from the top wall 23 and may be slightly curved. Within the bore of spout 30 is fixedly positioned a metal tubular can top piercing blade 31 having a lower end piercing point 32 and inclined or bias cut edges 33 to promote efficient opening of the top of the can 21 and the formation thereon of a flap 34, FIG. 1, which actually aids in positioning the blade 31 while dispensing the contents of the can through the pouring spout 30. The tubular blade 31 also preferably has a large side wall port 35 for the inflow of liquid.

Figure 2:
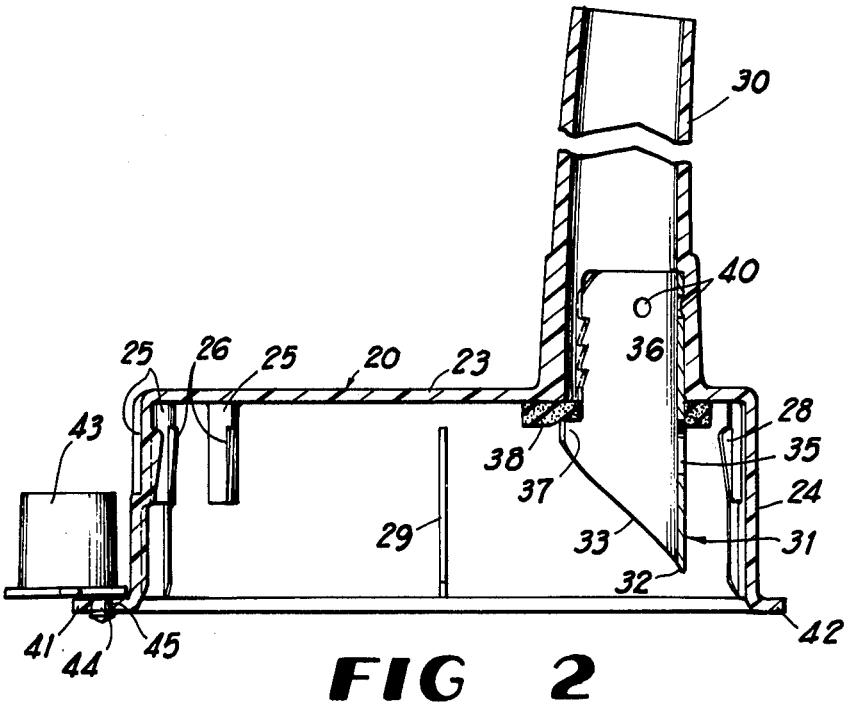
FIG. 2 is a central vertical section through the invention.

The tubular blade 31 is divided longitudinally as shown in FIG. 1 and has upper sets of opposing teeth 36 thereon which are embedded in the thermoplastic material from which the spout 30 is formed during the manufacturing process; the spout 30 is heated and softened and the blade 31 is inserted into the bottom of the spout 30 to the depth shown in FIG. 2 and the plastic material flows over the teeth 36 to lock the blade 31 securely within the spout 30 after cooling of the plastics material.

Below the teeth 36 and the top wall 23, the tubular blade 31 has a pair of spaced lugs 37 thereon which engage below a compressible gasket 38 and clamp the latter securely against the flat bottom surface of the wall 23. As best shown in FIG. 1, the gasket 38 is shaped as at 39 to align itself circumferentially on the tubular blade 31. The gasket 38 being soft and comparatively thick forms a seal with the top of the can 21 during usage and also forms a seal with the tubular blade 31 so that there will be no leakage and spillage of oil or other liquid during the pouring operation. The blade 31 may have other aperture means 40 to anchor the blade in the plastics material of the spout 30.

In the regions of the indentations 25 and 27, horizontal flanges or lips 41 and 42 are formed on the device at the bottom of the skirt 24 and projecting outwardly thereof at right angles thereto. These lips assist in the application and removal of the device onto and from a can 21 as illustrated particularly in FIGS. 5 to 9.

A closure plug 43 for the pouring spout 30 is provided so that the outer end of the spout may be closed when the device or cover is stored on a can with part of the can contents remaining in it. The plug 43 is releasably held on the flange 41 by a headed pin element 44 having releasable snapping engagement in an aperture 45 of the flange 41 allowing the plug to be easily removed for usage. Manipulating projections 46 are preferably provided on the base of the plug 43, as shown in the drawings.

Figure 6:
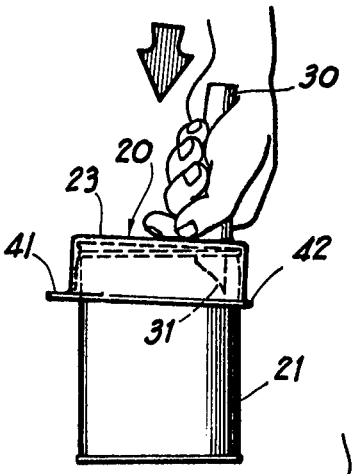
Figure 7:
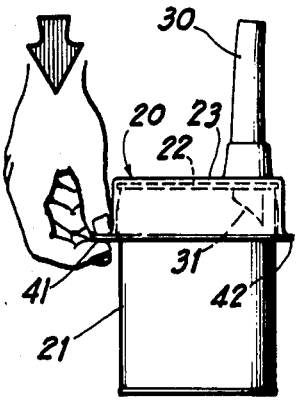

In view of the foregoing structural description, the mode of use of the invention should be substantially self-evident. However, with reference to operational FIGS. 5 through 9, a user may grasp the pouring spout 30 immediately above the top wall 33 and press downwardly on the device 20 in the direction of the arrow to bring the lower point 32 of the tubular piercing blade 31 into contact with the top of the can 21. Further downward pressure, as shown in FIG. 6, will pierce the can top and produce the flap 34 shown in FIG. 1. In the piercing operation, the can side wall may deform somewhat as at 47 in FIG. 6 and the device 20 may assume a slightly cocked position at this moment. Referring to FIG. 7, the flange 41 may now be forced downwardly by hand to complete the application of the opening and pouring attachment with the can bead 22 fully engaged between the tops of the ribs 26 and 28 and the top wall 23 of the device or cover.

Figure 8:
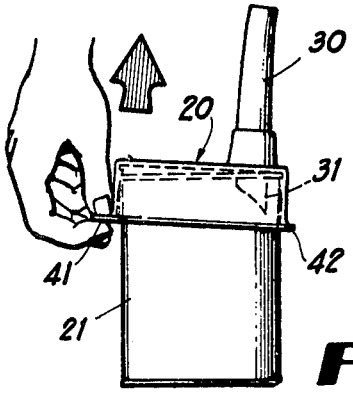
Figure 9:
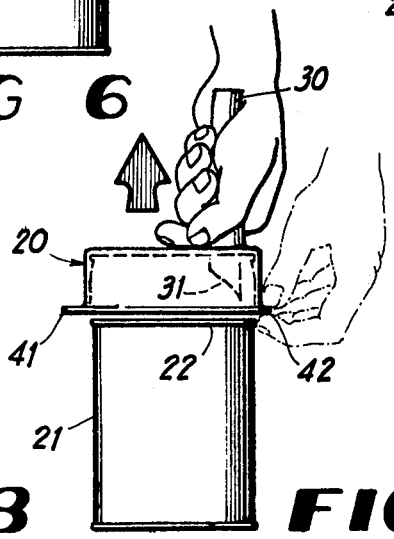

FIGS. 8 and 9 show the reverse operations of removing the device from the can 21, wherein the lip 41 is first grasped and lifted and finally in FIG. 9 the spout 30 and the other lip 42 are manipulated to entirely separate the device from the can.

The invention is unitary and very convenient to manipulate. It is inexpensive in construction and provides an effective liquid seal around the blade 31 and between the top of the can and the pouring device. As fully explained, the device is adaptable to both paper and metal cans which are widely used in marketing motor oil. The advantages of the invention over the prior art should be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

What I claim is:

1. An opening and contents pouring device for a cylindrical side wall container having a top container bead comprising: a body portion adapted to be engaged telescopically over one end portion of a container and having a cover top wall, an annular skirt integrally formed with and depending from said cover top wall, a yielding internal rib element on said skirt and spaced below said cover top wall and adapted to engage said cylindrical side wall and to releasably lock said container bead between the top of said rib element and said cover top wall, a yielding indentation formed on the exterior circumference of said skirt and said internal rib element being formed on the interior of said indentation, a pouring spout rising from said cover top wall, and a container piercing blade anchored within said spout and having a piercing portion projecting below said cover top wall and within said skirt.

2. An opening and contents pouring device as claimed in claim 1 wherein said internal rib element is vertically elongated and has an interior longitudinal edge which converges upwardly.

3. An opening and contents pouring device as claimed in claim 1 wherein said device includes a plurality of said indentations circumferentially spaced on said skirt and a respective number of said internal rib elements on the interiors of each of said indentations.

4. An opening and contents pouring device as claimed in claim 3 wherein the inward radial projection of at least one of said internal rib elements is greater than the inward radial projection of the remainder of said internal rib elements.

5. An opening and contents pouring device as claimed in claim 4 wherein said device further includes at least one additional yielding indentation formed on the exterior circumference of said skirt and an internal rib element formed on the interior of said additional yielding indentation, said additional yielding indentation being diametrically opposite from said plural indentations.

6. An opening and contents pouring device as claimed in claim 1 wherein said blade is tubular, having a lower end container piercing point, an inclined piercing edge rising from said point, rigid lug means formed on said blade above said inclined piercing edge, and a compressible gasket surrounding said blade and engaging the bottom surface of said cover top wall and being clamped against said cover top wall by said lug means.

7. An opening and contents pouring device as claimed in claim 6 wherein said blade is telescopically engaged within said spout and wherein anchoring teeth are formed thereon and are embedded in said spout.

8. A container opening and contents pouring device for a cylindrical side wall container having a top container bead comprising: a body portion adapted to be engaged telescopically over one end portion of a container and having a cover top wall, an annular skirt integrally formed with and depending from said cover top wall, plural spaced yielding internal rib elements on said skirt and spaced below said cover top wall and adapted to engage said cylindrical side wall and to releasably lock said container bead between ends of said rib elements and said cover top wall, a pouring spout rising from said cover top wall, a container piercing blade anchored within said spout and having a piercing portion projecting below said cover top wall and within said skirt, lug means formed on said blade above said piercing portion, a compressible gasket surrounding said blade and engaging the bottom surface of said cover top wall and being clamped against said cover top wall by said lug means, wherein said body portion and spout are formed as a unit from resilient plastics material, said skirt having a plurality of circumferentially spaced yielding indentations, and said rib elements being formed on the interiors of said indentations.

9. A container opening and contents pouring device as defined in claim 8, and said indentations extending from points near the axial center of said skirt through said cover top wall, said rib elements being vertically elongated and having interior longitudinal edges which converge upwardly, and the tops of the rib elements being equidistantly spaced from the bottom surface of said cover top wall.

10. A container opening and contents pouring device as defined in claim 9, and a flange carried by said skirt at its end away from said cover top wall and projecting radially outwardly of said skirt and adapted to be grasped to aid in applying the device to said container or in removing it from said container.

11. A container opening and contents pouring device as defined in claim 10, and a closure plug for said pouring spout removably mounted on said flange.

* * * * *